US006938969B2

(12) United States Patent
Shibasaki

(10) Patent No.: US 6,938,969 B2
(45) Date of Patent: Sep. 6, 2005

(54) IMAGE RECORDING METHOD AND APPARATUS

(75) Inventor: Souhei Shibasaki, Tokyo (JP)

(73) Assignee: Fuji Photo Film Co., Ltd., Kangawa (JP)

( * ) Notice: Subject to any disclaimer, the term of this patent is extended or adjusted under 35 U.S.C. 154(b) by 0 days.

(21) Appl. No.: 10/266,925

(22) Filed: Oct. 9, 2002

(65) Prior Publication Data

US 2003/0085977 A1 May 8, 2003

(30) Foreign Application Priority Data

Oct. 9, 2001 (JP) ..... 2001-311263

(51) Int. Cl.[7] ..... B41J 29/38
(52) U.S. Cl. ..... 347/12; 347/104
(58) Field of Search ..... 347/12, 2, 37, 347/40, 101, 104

(56) References Cited

U.S. PATENT DOCUMENTS 4,131,898 A * 12/1978 Gamblin ..... 347/41
4,208,666 A * 6/1980 Paranjpe ..... 347/104
5,018,884 A * 5/1991 Hirano et al. ..... 347/30
5,428,375 A * 6/1995 Simon et al. ..... 347/12
5,570,172 A * 10/1996 Acquaviva ..... 399/403
5,584,474 A * 12/1996 Viechter ..... 271/3.19
5,677,719 A * 10/1997 Granzow ..... 347/103
5,751,449 A * 5/1998 Nobuta ..... 358/498
5,838,343 A * 11/1998 Chapin et al. ..... 347/22
6,000,781 A * 12/1999 Akiyama et al. ..... 347/40
6,120,142 A * 9/2000 Eltgen et al. ..... 347/104
6,168,324 B1 * 1/2001 Lever et al. ..... 400/82

* cited by examiner

*Primary Examiner*—Manish Shah
*Assistant Examiner*—Leonard Liang
(74) *Attorney, Agent, or Firm*—Sughrue Mion, PLLC

(57) ABSTRACT

There is disclosed an image recording method for recording data on a recording material by a recording head which reciprocates in a direction substantially perpendicular to a conveyance direction of the recording material. A plurality of recording materials are conveyed in parallel with one anther and in the same direction, and a plurality of recording heads are independently driven on a common guide member, which is disposed to be perpendicular to the conveyance direction. The images are recorded on the plurality of recording materials in parallel with and independently of one another. The recording speed in recording the images on the plurality of recording materials can be increased. A high-speed recording is possible without deteriorating an image quality, and an apparatus is prevented from being enlarged.

18 Claims, 7 Drawing Sheets

IMAGE RECORDING METHOD AND APPARATUS

FIELD OF THE INVENTION

The present invention relates to an image recording method and apparatus in which characters or images are recorded on a recording material conveyed in one direction by a recording head running in a direction substantially perpendicular to the conveyance direction.

BACKGROUND OF THE INVENTION

There are known printers by various systems such as an ink jet system, thermal recording system, and wire dot recording system. On the other hand, with the spread of a digital camera or personal computer, there has been a demand for a printer in which digital image data can be recorded with high precision. It is to be noted that a printer for printing not only images but also characters. The images to be printed include the characters.

However, the printer has a problem that with a high minuteness of image quality, the number of pixels increases, and a print speed is reduced. To solve the problem and increase the print speed, the following methods have heretofore been proposed.

In a first prior method, a head having a large number of recording pixels is provided in order to increase an area be recorded or printed by one scanning operation. For example, in a recording head of the ink jet system, a multi-nozzles head having a large number of nozzles for jetting ink droplets is used.

FIG. 8 is a schematic view of such conventional method. In FIG. 8A, reference numeral 10 denotes a recording sheet (print sheet, recording material) which is conveyed in a sub scanning direction shown by an arrow 12, that is, in an upward direction on the drawing. 14 is a recording head of a color ink jet system, which is conveyed in a main scanning direction shown by an arrow 16, that is, reciprocated in a left to right direction on the drawing. For the recording head 14, as shown in an enlarged view of FIG. 8B, nozzles for jetting ink droplets having different colors, i.e., yellow (Y), magenta (M), cyan (C) and black (BK), are aligned as one set in the main scanning direction, and a large number of the same sets are arranged in the sub scanning direction.

In a second conventional printing method, a plurality of small-sized heads are combined or integrated to provide capabilities substantially similar to those of the multi-nozzle head. FIG. 9 is a schematic view showing this method. In this method, four small heads 18A to 18D having positions deviated with each other are combined with minute precision to form a multi-nozzle head 20. Here, the small heads 18A to 18D are combined in such a manner that recording areas are divided in the main scanning direction 16 and continuously arranged in the sub scanning direction 12.

As shown in a schematic view of FIG. 10, a third prior proposed method uses a plurality of independent printers 22A to 22D contained in a common case 24. The same image data of the same page or different image data of different pages are allocated to the respective printers 22A to 22D, the image data are recorded simultaneously in parallel with one another, and printed sheets are collected in one discharge tray 26.

In the first prior method as shown in FIGS. 8A, 8B, the recording head 14 is large in size. That is, a dimension 28 of the recording head 14 in the sub scanning direction increases as seen in FIG. 8A. However, when the head 14 is enlarged, the number of nozzles also increases. Therefore, problems occur that it becomes difficult to manufacture the head, dispersions generated in performance characteristics of the respective nozzles increase, and manufacturing yields of the heads are deteriorated.

Moreover, since a recording surface (ink jet surface) of the head 14 is disposed opposite to a platen (not shown) via the recording sheet 10, feed rollers for feeding the recording sheet 10 are positioned on the upstream and downstream sides of the platen. Therefore, an interval between the feed rollers is broadened, and the recording sheet 10 easily floats up above the platen. As a result, the distance between the recording sheet 10 and the ink nozzles of the head 14 fluctuates and this sometimes causes the deterioration of a recorded image quality.

In the second prior proposed method as shown in FIG. 9, it is difficult to combine the small heads 18A to 18D with good precision, high precision is not easily achieved, further the whole dimension of the multi-nozzle head 20 increases, and therefore the heads are enlarged. Moreover, the head 20 becomes heavy, and a width of the head 20 in the main scanning direction is broadened. This causes problems that a movement distance of the head 20 increases during main scanning and as a result a recording speed drops.

Moreover, since the dimension of the multi-nozzle head 20 in the sub scanning direction also increases, the interval between the feed rollers on the upstream and downstream sides of the multi-nozzle head 20 should be broadened. Therefore, similarly as the first conventional method, the distance between the recording sheet 10 and head 20 fluctuates and this causes a problem of the image quality deterioration.

In the third method as shown in FIG. 10, since a plurality of printers are substantially used, apparatus enlargement and cost increase are caused.

SUMMARY OF THE INVENTION

The present invention has been accomplished under the aforementioned circumstance, and a first object thereof is to provide an image recording method in which a recording head realizes compactness in size, manufacturing of the head is facilitated, a high-speed recording is possible without deteriorating an image quality, and an apparatus is prevented from being enlarged in size. Moreover, a second object is to provide an image recording apparatus for direct use in carrying out the method.

According to the present invention, the first object is attained by a provision of an image recording method for recording an image on a recording material by a recording head which reciprocates in a direction perpendicular to a conveyance direction of the recording material, the method comprising the steps of:

conveying a plurality of recording materials in parallel with one another and in the same direction;

arranging a plurality of recording heads so that the respective heads can independently be driven on a common guide member; and recording the images on the plurality of recording materials in parallel with and independently of one another by the plurality of recording heads.

For a recording system of the recording head, various systems such as an ink jet system, thermal recording system, thermal transfer recording system, and wire dot recording system can be applied.

In a case that recording materials or sheets have the same dimension, the respective recording heads may record different pages of image data. A plurality of pages can be recorded in parallel so that a high-speed recording is possible. When the same image is recorded on different recording materials by different recording heads, the speed in recording the same image on a plurality of sheets can be increased. In this case, the recording materials may have the same dimension or different dimensions.

When a difference is generated in a recording speed due to a difference of image data recorded by the respective recording heads and a difference of a recording area (dimension of the recording material), the completion of the recording in a main scanning direction by all the recording heads in the same sub scanning direction is waited for, and all the recording materials may be concurrently conveyed in the sub scanning direction.

According to the present invention, the second object is attained by a provision of an image recording apparatus for recording an image on a recording material by a recording head which reciprocates in a direction perpendicular to a conveying direction of the recording material, the apparatus comprising:

conveyance means for conveying a plurality of recording materials in parallel with one another and in the same conveyance direction;

a guide member disposed to be perpendicular to the conveyance direction; and a plurality of recording heads guided by said guide member and driven independently of one another, wherein the plurality of recording heads can record the images on the plurality of recording materials in parallel with and independently of one another.

The recording heads may record the same image or different images on the different recording materials. Since the same image data extracted from one image processor can be used in the same image, it is sufficient to dispose one image processor. Moreover, to record the different images, when different pages or portions of the same image data are recorded, it is sufficient to dispose one image processor.

The respective recording heads may include a plurality of nozzles aligned in the main scanning direction to eject ink droplets of different colors such as yellow (Y), magenta (M), cyan (C) and black (BK), so that a color recording can be performed by an ink jet system.

The plurality of recording materials or sheets are conveyed or fed by one common conveyance means in parallel and in the same direction, and the plurality of recording heads are guided and moved by the common guide member and driven independently. Therefore, the respective recording heads records the same image or different images on the different recording materials.

In the present invention, the image formed on the recording material includes graphical intelligence patterns such as alphanumeric characters, graphical display, line art, and other image information.

DESCRIPTION OF THE PREFERRED EMBODIMENTS

Figure 1:
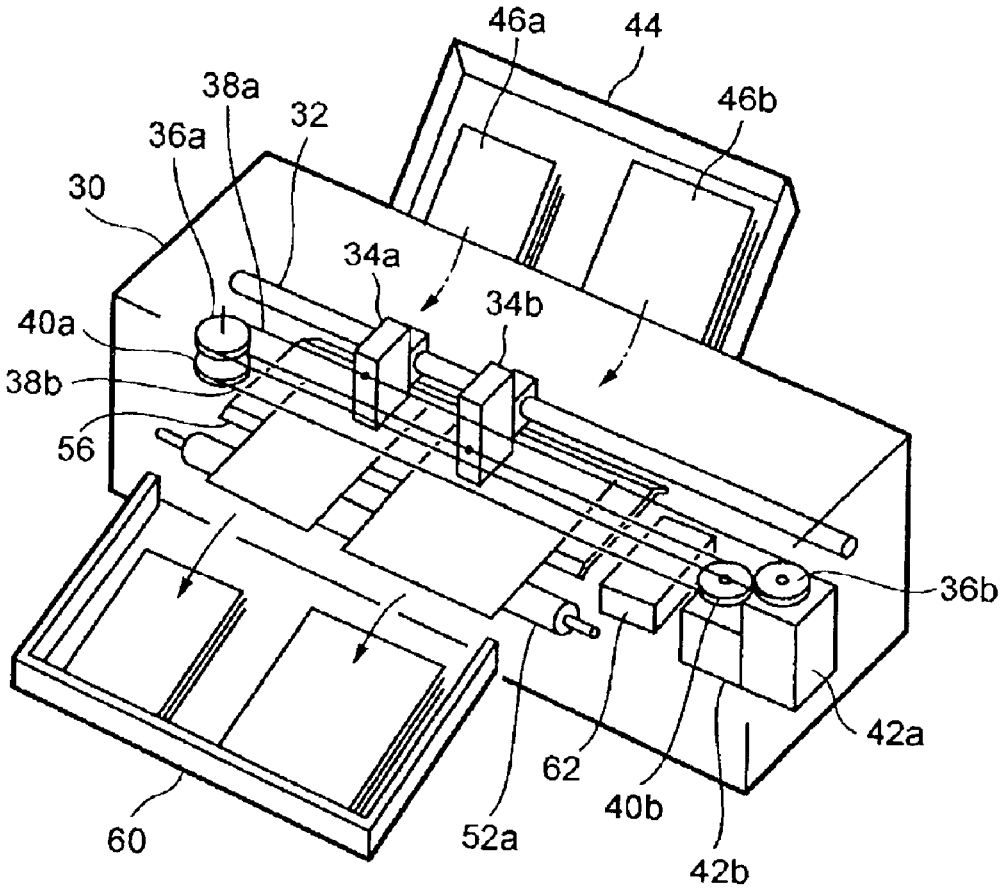
FIG. 1 is a schematic view showing an image printing apparatus according to one embodiment of the present invention.
Figure 2:
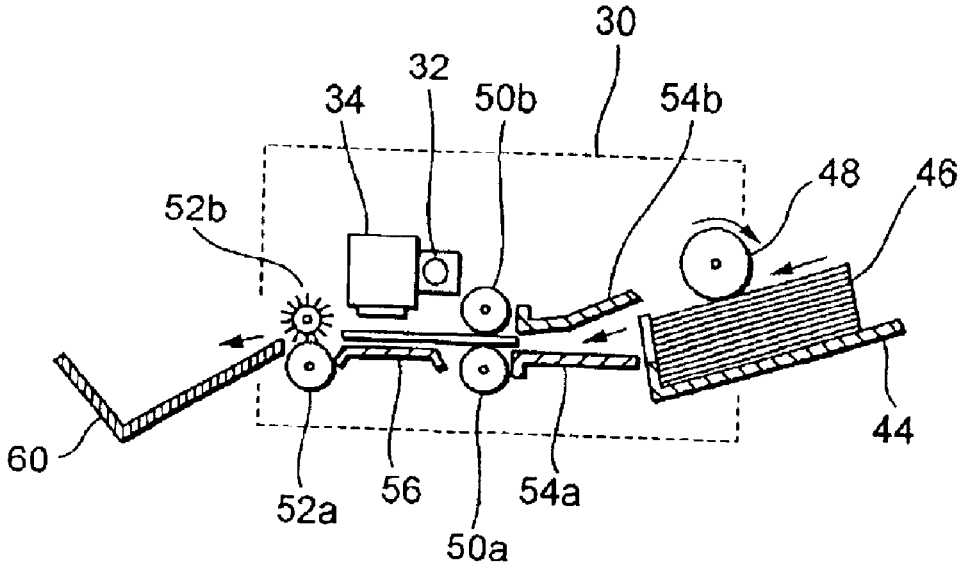
FIG. 2 is a side sectional view of the apparatus of FIG. 1.

In FIGS. 1, 2, reference numeral 30 denotes a housing case. A guide rod 32 is provided as a guide member into the case 30 in a width direction thereof. The guide rod 32 holds two ink jet heads 34 (34*a*, 34*b*) as recording heads so that the heads can move in a left to right direction (main scanning direction).

The head 34*a* is connected to opposite ends of a timing belt 38*a* wound around a pair of pulleys 36 (36*a*, 36*b*). Similarly, the head 34*b* is connected to opposite ends of a timing belt 38*b* wound around a pair of pulleys 40 (40*a*, 40*b*). The pulleys 36*b*, 40*b* are independently driven by a motor 42 (42*a*, 42*b*), and accordingly the respective timing belts 38*a*, 38*b* independently reciprocates from side to side. As a result, the ink jet heads 34 (34*a*, 34*b*) independently move from side to side.

Reference numeral 44 is a sheet supply tray in which print sheets 46 (46*a*, 46*b*) as two types of recording materials are contained in parallel in a width direction. The print sheets 46*a*, 46*b* are conveyed in parallel at the same speed by common conveyance means.

The conveyance means comprises a sheet supply roller 48 which contacts the print sheets 46*a*, 46*b* contained in the tray 44 from above, conveyance or feed rollers 50 (50*a*, 50*b*) disposed on an upstream side of the head 34, and conveyance rollers 52 (52*a*, 52*b*) disposed on a downstream side of the head 34. It is to be noted that one roller 52*b* of the conveyance rollers 52 is a needle pulley having needles on an outer periphery of the pulley. Thereby, a printed image on the surface of the sheet 46 onto which the ink has just been attached and is not dried is prevented from being disturbed. Moreover, reference numeral 54 (54*a*, 54*b*) is a conveyance guide, and 56 is a platen disposed opposite to the head 34.

The respective conveyance rollers 50, 52 of conveyance means constituted in this manner are driven by a conveyance motor 58 (FIG. 4), and the recording or print sheets 46*a*, 46*b* are synchronously conveyed and discharged to a sheet discharge tray 60. Here, fore end of the print sheets 46*a*, 46*b* are synchronized and fed into the conveyance rollers 50*a*, 50*b*, and thereafter the sheets are conveyed at the same speed. Therefore, when the sheets 46*a*, 46*b* are different from each other in dimension or size, rear end of the sheets are discharged at deviating times.

Figure 3:
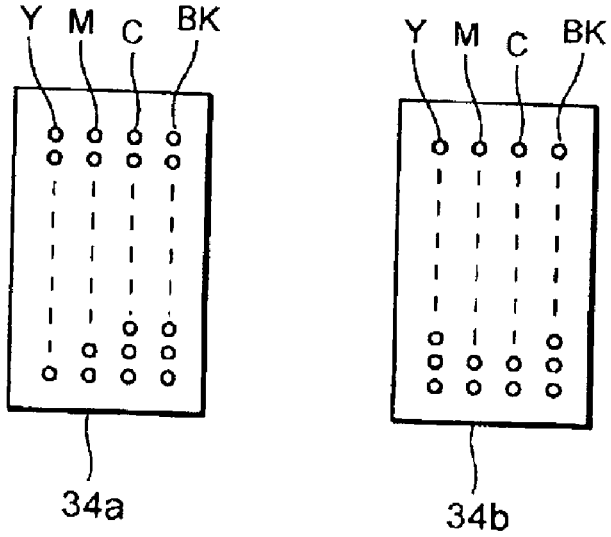
FIG. 3 is a diagram showing a nozzle arrangement of a recording head.

In the ink jet heads 34*a*, 34*b*, as shown in FIG. 3, a large number of ink jet nozzles are arranged. Specifically, four nozzles aligned in the main scanning direction, i.e., in a direction parallel to that of the guide rod 32 are regarded as one set, and a large number of sets are arranged in the sub scanning direction, i.e., in a direction perpendicular to the guide rod 32. That is, four nozzles for jetting yellow (Y), magenta (M), cyan (C) and black (BK) inks are regarded as one set, and this set is arranged at a density corresponding to minuteness of the image in the sub scanning direction.

In FIG. 1, reference numeral 62 is a cleaning unit which cleans the ink jet nozzles of the respective heads 34*a*, 34*b* in standby positions (home positions) of the heads 34*a*, 34*b*.

Figure 4:
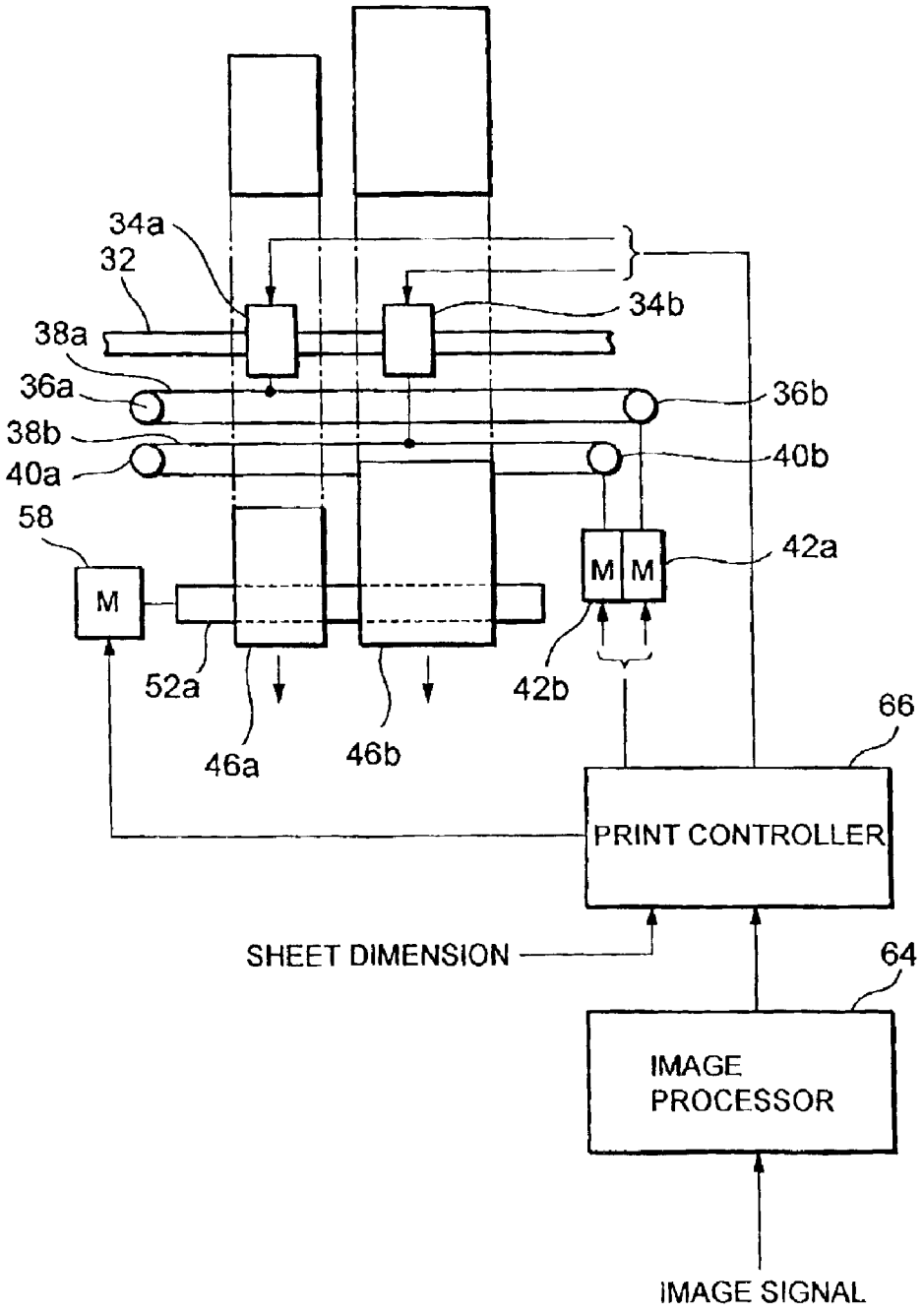
FIG. 4 is a block diagram showing a control system of the apparatus of the embodiment.

In FIG. 4, reference numeral 64 is an image processor for processing an image signal inputted from a not-shown device. Reference numeral 66 is a print controller for receiving the image signal subjected to the image processing by the image processor 64 and for performing printing of the images on the respective print sheets 46*a*, 46*b*. The controller controls the conveyance motor 58 (FIG. 4) to convey the sheets 46*a*, 46*b* to the sub scanning direction, controls the motor 42 for controlling the feed of the head 34 in the main scanning direction, and further controls an ink jet from the nozzle.

Figure 5A:
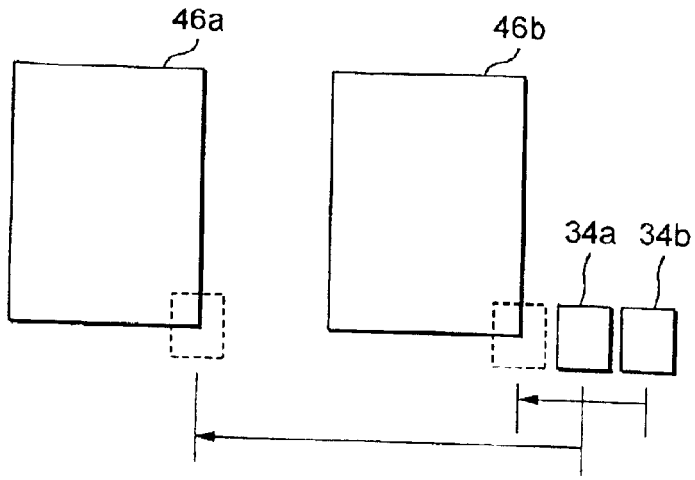
FIGS. 5A–5C are explanatory illustrations showing operations of the embodiment.
Figure 5B:
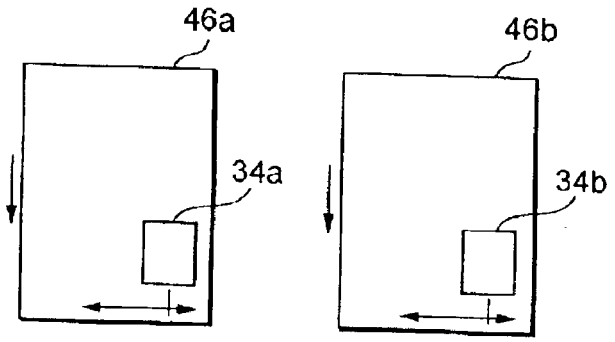
Figure 5C:
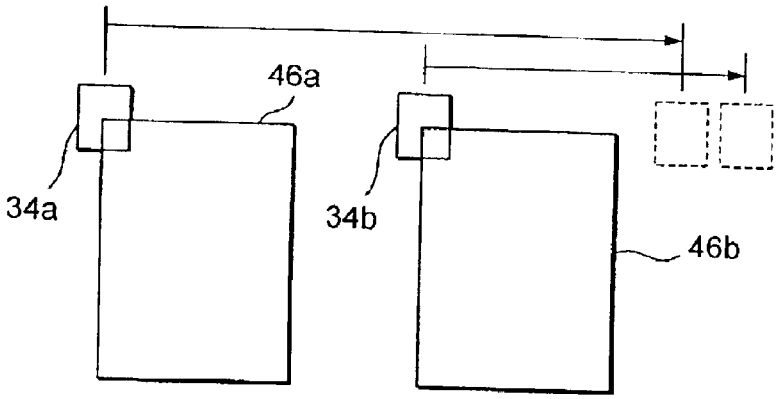

As shown in FIGS. 5A–5C, the heads 34*a*, 34*b* move to record or print the image on the print sheet 46. In the figures, since the sheets 46*a*, 46*b* are set to have the same dimension. Accordingly, the heads 34*a*, 34*b* substantially synchronously move, when the same image are printed on the sheets 46*a*, 46*b*.

Before a print start, as shown in FIG. 5A, the head 34 (34*a*, 34*b*) is on standby in the standby position. In this case, if necessary, the nozzles are cleaned. On receiving a print instruction, the print controller 66 uses the image signal subjected to the image processing to send instruction signals to heads 34*a*, 34*b*. The respective signals is corresponding to the dimension of the respective sheets 46*a*, 46*b*. The controller 66 also actuates the motors 58, 42 to perform printing of the image (FIG. 5B). In this case, the heads 34*a*, 34*b* reciprocate within print widths of the sheets 46*a*, 46*b*. Subsequently, when all the print operations are completed, the heads 34*a*, 34*b* are returned to the standby positions (FIG. 5C).

Figure 6A:
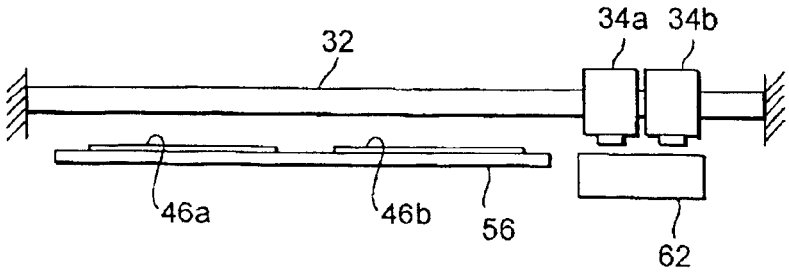
FIGS. 6A–6D are diagrams showing steps of a print operation.

FIGS. 6A–6D are explanatory views of different print operation modes using this apparatus. FIG. 6A corresponds to FIG. 5A, and shows that the heads are cleaned. In this case, the heads 34*a*, 34*b* are both in the standby positions, and cleaned by the cleaning unit 62.

Figure 6B:
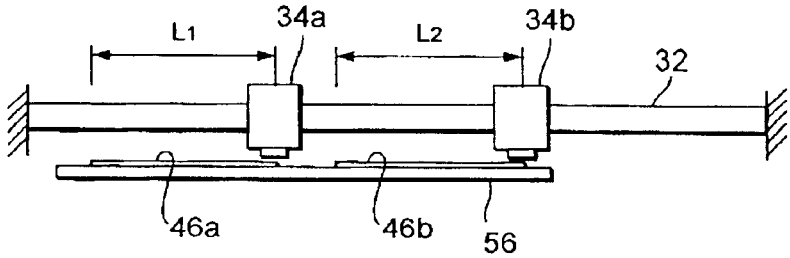

FIG. 6B shows printing states of the print sheets 46*a*, 46*b* which have the same dimension. For example, two photographs having an L size are printed. In this case, the respective heads 34*a*, 34*b* reciprocate within a width $L_1$ of each of the print sheets 46*a*, 46*b* to print the image. To print the same image, both heads 34*a*, 34*b* are synchronized. To print different images, one head 34*a* (or 34*b*) having completed a main scanning of one line earlier waits until the other head 34*b* (or 34*a*) completes a main scanning. After both the heads 34*a*, 34*b* complete main scannings, the print sheets 46*a*, 46*b* are concurrently conveyed in the sub scanning direction, and then the both heads 34*a*, 34*b* simultaneously start the next main scanning.

Figure 6C:
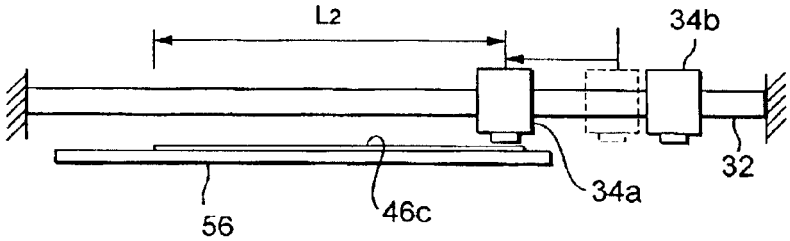

FIG. 6C shows that the image is printed on one broad print sheet 46*c*. For example, the image is printed on a sheet having an A4 size. In this case, only one head 34*a* reciprocates within a width $L_2$ of the sheet 46*c*, and the other head 34*b* is maintained in the standby position.

Figure 6D:
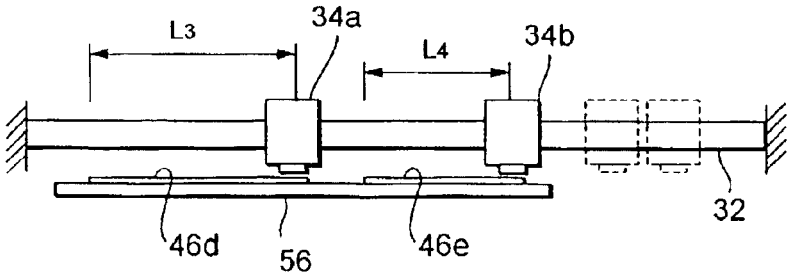

FIG. 6D shows that the images are printed on two print sheets 46*d*, 46*e* having different dimensions. For example, photographs having L and S sizes are printed. In this case, the respective heads 34*a*, 34*b* reciprocate within widths $L_3$, $L_4$ of the respective sheets 46*d*, 46*e*.

Figure 7:
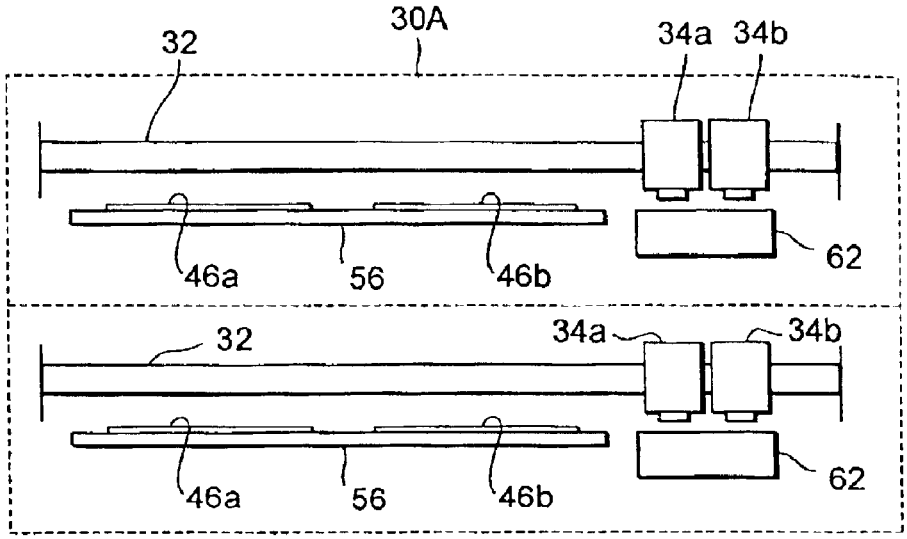
FIG. 7 is a diagram showing another embodiment of the present invention.
Figure 8A:
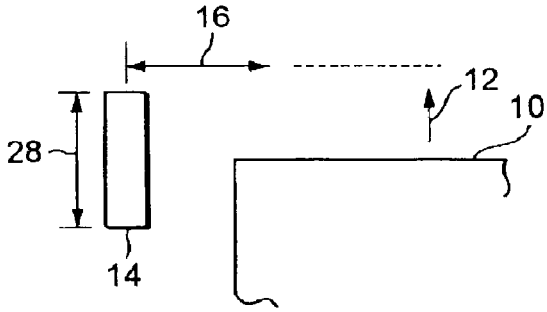
FIG. 8A (PRIOR ART)
FIGS. 8A–8B are diagrams showing the first conventional method.
Figure 8B:
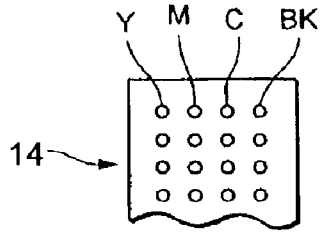
FIG. 8B (PRIOR ART)
Figure 9:
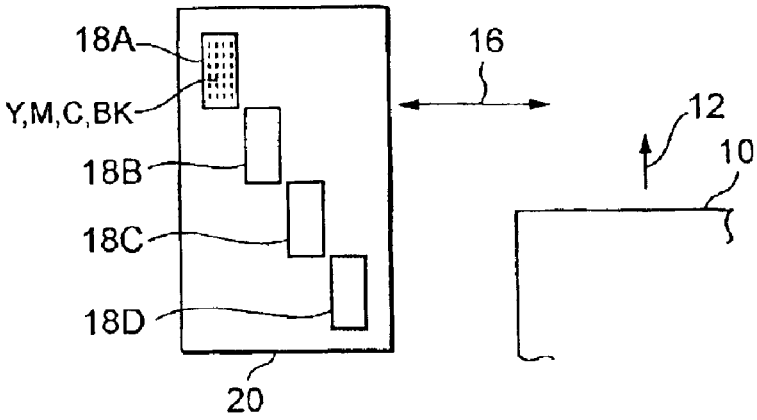
FIG. 9 (PRIOR ART)
FIG. 9 is a diagram showing the second conventional method.
Figure 10:
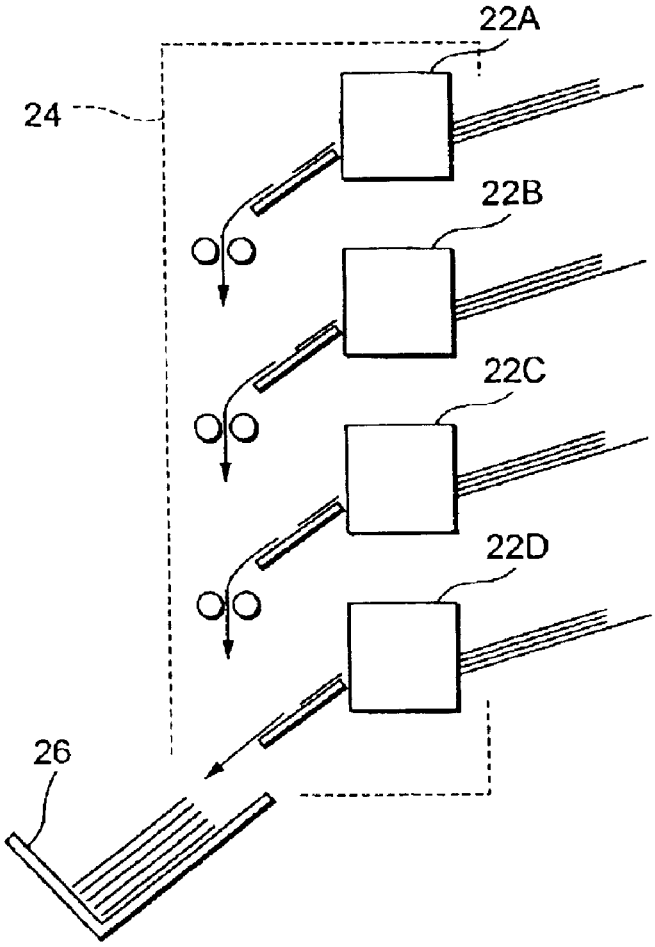
FIG. 10 (PRIOR ART)
FIG. 10 is a diagram showing the third conventional method.

FIG. 7 is a diagram showing another embodiment. In this embodiment, the image recording apparatus described above with reference to FIGS. 1 to 6 is disposed in upper and lower stages and contained in a common case 30A. The image processor may separately be disposed for the image recording apparatuses disposed in the respective stages, but a common image processor may also be disposed. In FIG. 7, the same part as that of FIGS. 1 to 6 is denoted with the same reference numeral, and the description thereof is not repeated.

According to the embodiment, since the images can simultaneously be printed on four print sheets in parallel, the print speed can further be increased. The arrangement is not limited to two stages of the image recording apparatuses, and the image recording apparatuses may also be stacked in three or more stages. Moreover, the number of heads 34 held on the common guide rod 32 is not limited to two, and three or more heads may also be disposed. Similarly, the number of print sheets simultaneously conveyed in parallel can also be two or more.

As described above, according to the present invention, the plurality of recording materials are conveyed in parallel with one another and in the same direction, and the plurality of recording heads are independently driven on the common guide member to record the images on the plurality of recording materials in parallel with and independently of one another. Therefore, the recording speed in recording the images on the plurality of recording materials can be increased.

Moreover, since a small-sized and light-weighted recording head can be used, it is easy to manufacture the head, and the movement speed of the head can be increased to increase the recording speed by each head. Here, with the compactness of the respective heads, the interval between the conveyance rollers for holding the recording material before and after the platen is narrowed, the distance between the head and recording material is stabilized, and therefore the recorded image quality is prevented from being deteriorated.

Furthermore, the plurality of recording materials are conveyed by the common conveyance means in parallel with one another, and the plurality of heads are guided by the common guide member. Therefore, different from a case in which the plurality of heads are combined or integrated to increase the recording area of the head, or in which the plurality of independent printers are combined, there is not fear that the whole apparatus is enlarged.

According to the present invention, when the recording materials conveyed in parallel with one another have the same dimension, the plurality of recording heads can simultaneously record different two pages of the image data including the plurality of pages in parallel with each other. The dimensions of the recording materials are set to be or not to be the same, so that the plurality of recording heads may record the same image data.

The respective recording heads have a difference in a main scanning speed because of a difference in the image data to be recorded by the respective heads or in the dimensions of the recording materials. In this case, after waiting until the main scanning by each recording head is completed, the next main scanning may be performed.

According to another aspect of the present invention, there is obtained an image recording apparatus for direct use in carrying out any method according to the above-described invention.

What is claimed is:

1. An image recording method for recording an image on a recording material by a recording head which reciprocates in a direction perpendicular to a conveyance direction of the recording material, the method comprising the step of:

conveying a plurality of recording materials in parallel with one another and in the same direction;

arranging a plurality of recording heads so that the respective heads can independently be driven on a common guide member;

first moving one of the plurality of recording heads on the guide member, second moving another of the plurality of recording heads on the guide member independently of the first moving; and recording the images on the plurality of recording materials in parallel with and independently of one another by the plurality of recording heads.

2. The image recording method according to claim 1, further comprising the steps of:

waiting until a main scanning with respect to the respective recording materials by all the recording heads is completed; and synchronizing and conveying all the recording materials in a sub scanning direction.

3. The image recording method according to claim 1, wherein said plurality of recording materials have the same dimension; and wherein said plurality of recording heads record different images on the different recording materials.

4. The image recording method according to claim 3, further comprising the steps of:

waiting until a main scanning with respect to the respective recording materials by all the recording heads is completed; and synchronizing and conveying all the recording materials in a sub scanning direction.

5. The image recording method according to claim 1, wherein said plurality of recording heads record the same images on the plurality of the recording materials, in parallel with one another.

6. The image recording method according to claim 5, further comprising the steps of:

waiting until a main scanning with respect to the respective recording materials by all the recording heads is completed; and synchronizing and conveying all the recording materials in a sub scanning direction.

7. The image recording method according to claim 1, wherein the step of recording includes recording a first image on a first recording material and recording a second image on a second recording material substantially simultaneously.

8. The image recording method according to claim 1, wherein the plurality of recording materials comprise a first recording sheet and a second recording sheet and the first and the second recording sheets are conveyed in parallel.

9. The image recording method according to claim 8, wherein the first and the second recording sheets are not webs.

10. The image recording method according to claim 8, wherein the one of the plurality of recording heads records on the first recording sheet and the another of the plurality of recording heads records on the second recording sheet.

11. The image recording method according to claim 1, wherein the plurality of recording materials comprise a first discrete recording sheet and a second discrete recording sheet and the first and the second discrete recording sheets are conveyed in parallel.

12. An image recording apparatus for recording an image on a recording material by a recording head which reciprocates in a direction perpendicular to a conveyance direction of the recording material, the apparatus comprising:

conveyance means for conveying a plurality of recording materials in parallel with one another and in the same conveyance direction;

a guide member disposed to be perpendicular to the conveyance direction;

a plurality of recording heads guided by said guide member and driven independently of one another;

a first moving means for moving one of the plurality of recording means on the guide member; and a second moving means for moving another of the plurality of recording heads on the guide member independently of the first moving means;

wherein the plurality of recording heads can record the images on the plurality of recording materials in parallel with and independently of one another.

13. The image recording apparatus according to claim 12, wherein the respective recording heads record the same image on the respective recording materials based on the same image signal.

14. The image recording apparatus according to claim 12, wherein the respective recording heads eject an ink droplet toward the recording material by an ink jet system.

15. The image recording apparatus according to claim 14, wherein the respective recording heads record the same image on the respective recording materials based on the same image signal.

16. The image recording apparatus according to claim 12, wherein the respective recording heads include, a plurality of nozzles arranged in a main scanning direction to eject ink droplets of different colors by an ink jet system so that a color image is recorded on the respective recording materials.

17. The image recording apparatus according to claim 12, further comprising:

a first belt positioning one of the plurality of recording heads on the guide member; and a second belt positioning another of the plurality of recording heads on the guide member independently of the first belt.

18. The image recording apparatus according to claim 12, wherein the plurality of recording heads record the images on the plurality of recording materials substantially simultaneously.

* * * * *